US005863698A

United States Patent [19]

Patel et al.

[11] Patent Number: 5,863,698

[45] Date of Patent: Jan. 26, 1999

[54] TONER PROCESSES

[75] Inventors: Raj D. Patel, Oakville; Paul F. Smith, Toronto; Beverly C. Dutoff, Mississauga; Nan-Xing Hu, Oakville; Beng S. Ong, Mississauga; Michael A. Hopper, Toronto, all of Canada

[73] Assignee: Xerox Corporation, Stamford, Conn.

[21] Appl. No.: 58,733

[22] Filed: Apr. 13, 1998

[51] Int. Cl.[6] ..... G03G 9/087

[52] U.S. Cl. ..... 430/137

[58] Field of Search ..... 430/137

[56] References Cited

U.S. PATENT DOCUMENTS

| | | | |
|---|---|---|---|
| 3,674,736 | 7/1972 | Lerman et al. | 264/15 |
| 4,137,188 | 1/1979 | Uetake et al. | 264/15 |
| 4,558,108 | 12/1985 | Alexandru et al. | 526/340 |
| 4,797,339 | 1/1989 | Maruyama et al. | 430/109 |
| 4,983,488 | 1/1991 | Tan et al. | 430/137 |
| 4,996,127 | 2/1991 | Hasegawa et al. | 430/109 |
| 5,066,560 | 11/1991 | Tan et al. | 430/137 |
| 5,278,020 | 1/1994 | Grushkin et al. | 430/137 |
| 5,290,654 | 3/1994 | Sacripante et al. | 430/137 |
| 5,308,734 | 5/1994 | Sacripante et al. | 430/137 |
| 5,344,738 | 9/1994 | Kmiecik-Lawrynowicz et al. | 430/137 |
| 5,346,797 | 9/1994 | Kmiecik-Lawrynowicz et al. | 430/137 |
| 5,348,832 | 9/1994 | Sacripante et al. | 430/109 |
| 5,364,729 | 11/1994 | Kmiecik-Lawrynowicz et al. | 430/137 |
| 5,366,841 | 11/1994 | Patel et al. | 430/137 |
| 5,370,963 | 12/1994 | Patel et al. | 430/137 |
| 5,403,693 | 4/1995 | Patel et al. | 430/137 |
| 5,405,728 | 4/1995 | Hopper et al. | 430/137 |
| 5,418,108 | 5/1995 | Kmiecik-Lawrynowicz et al. | 430/137 |
| 5,496,676 | 3/1996 | Croucher et al. | 430/137 |
| 5,501,935 | 3/1996 | Patel et al. | 430/137 |
| 5,527,658 | 6/1996 | Hopper et al. | 430/137 |
| 5,585,215 | 12/1996 | Ong et al. | 430/107 |
| 5,650,255 | 7/1997 | Ng et al. | 430/137 |
| 5,650,256 | 7/1997 | Veregin et al. | 430/137 |
| 5,766,818 | 6/1998 | Smith et al. | 430/137 |

*Primary Examiner*—Roland Martin
*Attorney, Agent, or Firm*—E. O. Palazzo

[57] ABSTRACT

A process for the preparation of toner comprising mixing a colorant containing a surfactant and a latex emulsion, and wherein the latex emulsion contains resin and a nonionic hydrolyzable surfactant, and wherein said surfactant is of the Formulas (I) or (II), or optionally mixtures thereof

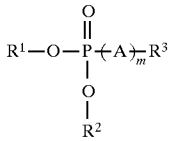

(I)

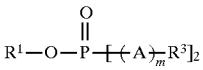

(II)

wherein $R^1$ is a hydrophobic aliphatic, or hydrophobic aromatic group; $R^2$ is selected from the group consisting of hydrogen, alkyl, aryl, alkylaryl, and alkylarylalkyl; $R^3$ is hydrogen or alkyl; A is a hydrophilic polymer chain, and m represents the number of A segments; heating below about the resin latex glass transition temperature, followed by the addition of an anionic stabilizer, thereafter heating above about the resin glass transition temperature, and adjusting the pH of the resulting mixture of resin and colorant particles suspended in an aqueous phase containing anionic surfactant, cationic surfactant and nonionic hydrolyzable surfactant, wherein said pH is increased from about 1.7 to about 2.5 to about 6 to about 12 by adding a base during the heating above about said resin glass transition temperature wherein coalescence is being accomplished.

28 Claims, No Drawings

TONER PROCESSES

PENDING APPLICATION

Illustrated in copending application U.S. Ser. No. 960,754, entitled "Surfactants", the disclosure of which is totally incorporated herein by reference are novel surfactants, that is cleavable or hydrolyzable surfactants of the Formulas (I), (II), or (III), and which surfactants, especially those of Formulas (I), (II), or mixtures thereof may be selected for the processes of the present invention. Also, toner processes wherein the cleavable surfactants are selected are illustrated in U.S. Pat. No. 5,766,818, the disclosure of which is totally incorporated herein by reference. The appropriate components and processes of the above copending applications may be selected for the present invention in embodiments.

BACKGROUND OF THE INVENTION

The present invention is generally directed to toner processes, and more specifically, to aggregation and coalescence or fusion of latex, colorant, like pigment, dye, or mixtures thereof, and optional additive particles, and wherein washing of the toner is avoided. In embodiments, the present invention is directed to toner processes which provide toner compositions with, for example, a volume average diameter of from about 1 micron to about 20 microns, and preferably from about 2 microns to about 10 microns, and a narrow particle size distribution of, for example, from about 1.10 to about 1.35 as measured by the Coulter Counter method, without the need to resort to conventional pulverization and classification methods, and wherein washing of the toner is avoided or the number of washings are reduced. In important embodiments, the present invention relates to the use of cleavable nonionic surfactants, and which surfactants can be readily hydrolyzed during coalescence, by adjusting the pH to a slightly acid to basic regime, for example about 6.0 to about 11.0.

The toners generated with the processes of the present invention are especially useful for imaging processes, inclusive of digital processes and xerographic processes, which usually require a high toner transfer efficiency, such as those with a compact machine design without a cleaner or those that are designed to provide high quality colored images with excellent image resolution, acceptable signal-to-noise ratio, and image uniformity.

PRIOR ART

There is illustrated in U.S. Pat. No. 4,996,127 a toner of associated particles of secondary particles comprising primary particles of a polymer having acidic or basic polar groups and a coloring agent. The polymers selected for the toners of the '127 patent can be prepared by an emulsion polymerization method, see for example columns 4 and 5 of this patent. In column 7 of this '127 patent, it is indicated that the toner can be prepared by mixing the required amount of coloring agent and optional charge additive with an emulsion of the polymer having an acidic or basic polar group. In U.S. Pat. No. 4,983,488, there is disclosed a process for the preparation of toners by the polymerization of a polymerizable monomer dispersed by emulsification in the presence of a colorant and/or a magnetic powder to prepare a principal resin component and then effecting coagulation of the resulting polymerization liquid in such a manner that the particles in the liquid after coagulation have diameters suitable for a toner. It is indicated in column 9 of this patent that coagulated particles of 1 to 100, and particularly 3 to 70 microns, are obtained. This process results, it is believed, in the formation of particles with a wide particle size distribution. Similarly, the aforementioned disadvantages, for example poor particle size distributions, are obtained hence classification is required resulting in low toner yields, as illustrated in other prior art, such as U.S. Pat. No. 4,797,339, wherein there is disclosed a process for the preparation of toners by resin emulsion polymerization, wherein similar to the '127 patent certain polar resins are selected; and U.S. Pat. No. 4,558,108, wherein there is disclosed a process for the preparation of a copolymer of styrene and butadiene by suspension polymerization. Other prior art that may be of interest includes U.S. Pat. Nos. 3,674,736; 4,137,188 and 5,066,560.

Emulsion/aggregation/coalescense processes for the preparation of toners with optional charge control additives are illustrated in a number of Xerox patents, the disclosures of each of which are totally incorporated herein by reference, such as U.S. Pat. No. 5,290,654, U.S. Pat. No. 5,278,020, U.S. Pat. No. 5,308,734, U.S. Pat. No. 5,370,963, U.S. Pat. No. 5,344,738, U.S. Pat. No. 5,403,693, U.S. Pat. No. 5,418,108, U.S. Pat. No. 5,364,729, and U.S. Pat. No. 5,346,797; and also of interest may be U.S. Pat. Nos. 5,348,832; 5,405,728; 5,366,841; 5,496,676; 5,527,658; 5,585,215; 5,650,255; 5,650,256 and 5,501,935 (spherical toners).

The appropriate components and processes of the above Xerox patents can be selected for the processes of the present invention in embodiments thereof.

SUMMARY OF THE INVENTION

It is a feature of the present invention to provide toner processes with many of the advantages illustrated herein.

In another feature of the present invention there are provided simple and economical processes for the preparation of black and colored toner compositions with excellent colorant dispersions, thus enabling the achievement of excellent color print quality, and wherein washing of the toner to obtain high toner triboelectrical charging characteristics is avoided.

In a further feature of the present invention there is provided a process for the preparation of toner compositions, with a volume average diameter of from between about 1 to about 20 microns, and preferably from about 2 to about 10 microns, and a particle size distribution of about 1.10 to about 1.35, and preferably from about 1.15 to about 1.35 as measured by a Coulter Counter without the need to resort to conventional classifications to narrow the toner particle size distribution.

In a further feature of the present invention there is provided a process for the preparation of toner by aggregation and coalescence, of latex resin, colorant, and additive particles, and wherein there is selected a hydrolyzable nonionic surfactant for the latex preparation and wherein the pH is adjusted or increased to 8.5 from about 2 during the second half of coalescence, that is heating above about the resin Tg, and wherein the second half refers for example, after 2 to 4.5 hours when the total coalescence time is 5 hours, and which pH increase enables for example, the hydrolysis of the nonionic surfactant into hydrophobic and hydrophilic fragrants.

In yet another feature of the present invention there are provided toner compositions with low fusing temperatures of from about 120 degrees Centigrade to about 180 degrees Centigrade, and which toner compositions exhibit excellent blocking characteristics at and above about 45 degrees Centigrade.

In still a further feature of the present invention there are provided toner compositions which provide high image projection efficiency, such as for example over 75 percent as measured by the Match Scan II spectrophotometer available from Million-Roy.

The present invention involves the preparation of toner size particles by the aggregation of submicron resin particles suspended in an aqueous media containing an anionic surfactant and a hydrolyzable nonionic surfactant, with submicron colorant particles containing a cationic surfactant; followed by stirring and heating the resulting mixture to a temperature below the resin glass transition temperature (Tg) to obtain loosely bound aggregates of resin and colorant particles; wherein the loosely bound aggregates are electrostatically held together and can be easily broken-down by high speed shearing devices such as a ploytron, where the speeds would be in the range of about 1,000 to about 8,000 and preferably in the range of about 1,500 to about 5,000 rpm (revolutions per minute) and which aggregates which are in the size range of for example about 2 to about 10 microns can be broken down into the size range of about 0.8 to about 2 microns, while also withstanding Coulter Counter measurements, followed by the addition of a stabilizer to prevent, or minimize any further growth of the aggregates during coalescence upon increasing the reactor contents temperature to about 30 to about 60 degrees Centigrade above the resin Tg and wherein the aggregates containing resin and colorant particles are fused or coalesced; followed by a pH adjustment, that is a pH increase to slightly acidic/basic that is for example, a pH of about 6 to about 12, as measured with a pH meter of the mixture, comprised of resin and colorant particles suspended in an aqueous media of mixed surfactants such as anionic, cationic and nonionic surfactants. Optionally the pH adjustment, or increase can be accomplished upon completion of the coalescence followed by cooling down the reactor contents comprised of resin, colorant, and optionally known toner additives, down to for example, about 60 to about 80 degrees Centigrade; followed by a pH increase to 8.5 from about 2.0 by the addition of a base, and thereafter stirring for a period of about 0.5 to about 20 hours and preferably in the range of about 1 to about 10 hours. The pH adjustment, or increase is preferably performed at elevated temperatures in the range of for example about 80 to about 98 degrees Centigrade and preferably in the range of about 85 to about 95 degrees Centigrade, during the coalescence, wherein the loosely bound aggregates are being fused or melted and while the pH is being increased the nonionic hydrolyzable surfactant is being cleaved, and there is provided after cooling and isolation toner particles with a clean surface or clean coalescence.

The preparation of toner size particles in the size range of for example about 3 to about 12 microns (volume average throughout)and preferably in the range of about 4 to about 9 microns can be accomplished by the aggregation of submicron resin particles in the size range of about 0.05 to about 0.5 microns and preferably in the range of about 0.08 to about 0.4 microns suspended in an aqueous media containing an anionic surfactant in the amount of for example about 0.1 to about 5 and preferably about 0.15 to about 4 weight percent by weight of water and a hydrolyzable nonionic surfactant, in for example an amount of about 0.1 to about 5 and preferably about 0.15 to about 4 weight percent by weight of water, with submicron colorant particles in the size range of for example about 0.05 to about 0.5 microns and preferably about 0.08 to about 0.4 microns containing a cationic surfactant in an amount for example of about 0.1 to about 5 and preferably about 0.15 to about 4 weight percent by weight of water; followed by stirring and heating the above mixture to a temperature of about 5 to about 10 degrees Centigrade below the resin glass transition temperature (Tg) to obtain loosely bound aggregates of resin and colorant particles wherein the aggregates are in the size range of for example about 3 to about 10 microns and preferably from about 4 to 9 microns; followed by the addition of a surfactant stabilizer in an amount for example about 0.2 to 10 weight percent and preferably in about 0.25 to about 5 by weight of water, to prevent any further growth of the aggregates during the coalescence step and increasing the temperature about 30 to 60 degrees Centigrade above the resin Tg, where the aggregates containing resin and colorant particles are fused or coalesced; followed by a pH adjustment of the reactor contents comprised of resin and colorant particles suspended in an aqueous media of mixed surfactants such as anionic, cationic and nonionic surfactants, to a pH range which is slightly acidic to a basic condition, that is for example, a pH increase to about 6 to about 12 and preferably from about 7 to 11.5, as measured with a pH meter, and which pH is achieved by the addition of a base. The pH adjustment is preferably accomplished at elevated temperatures for example, in the range of about 75 degrees Centigrade to about 120 degrees Centigrade and preferably in about 80 to about 115 degrees Centigrade and during coalescence, where the loosely bound aggregates are being fused or melted and at the same time the nonionic hydrolyzable surfactant is being cleaved under basic pH conditions, providing toner particles with a clean surface, thereby reducing or eliminating or minimizing the need for down stream operations, such as washing.

Of importance with the processes of the present invention is that pH of the reactor contents comprised of resin and colorant particles suspended in an aqueous media of mixed surfactants such as anionic, cationic and nonionic surfactants be changed from acidic conditions where the pH is in the range of 1.7 to 2.5 to basic conditions in a pH range which is slightly acidic to basic that is for example, a pH of about 6 to about 12 and preferably from about 7 to about 11.5, as measured with a pH meter during coalescence, and more specifically the pH increase is accomplished in the second half of the coalescence wherein the second half of the coalescence refers to the time the pH of the reactor contents is adjusted, for example between about 2 to about 3.5 hours when the coalescence time is for example about 4 to about 7 hours. During the pH increase the nonionic hydrolyzable surfactant is constantly being cleaved or hydrolysed at elevated temperatures in the range of for example about 80 to about 98 degrees Centigrade and preferably about 85 to about 95 degrees Centigrade wherein the cleaving rate is 4 to 6 times faster compared to the cleaving or hydrolysis rate at room temperature. This provides toner particles with a cleaner and smoother surfaces in a very effective manner.

More specifically the present invention relates to toner processes wherein there is preferably selected about submicron in size colorant and resin particles in the size range of about 0.005 to about 0.5 microns and preferably about 0.08 to about 0.4 microns, wherein during the coalescence and more specifically in the second half of the coalescence the pH is adjusted to basic, such as from about 6.5 to about 13, and preferably to about 8.0 to 12, by the addition of a base, such as potassium hydroxide wherein clean coalescence of the toner particles is conducted enabling effective removal of surfactant from the toner particles thereby eliminating, or substantially reducing the washing of the toner particles to for example, about one washing, and wherein in embodiments the surfactant selected, especially for the latex, is a cleavable nonionic surfactant of copending application U.S. Ser. No. 960,754, and more specifically, Formulas (I) or (II), or mixtures thereof

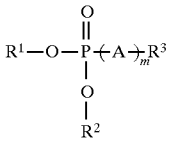

(I)

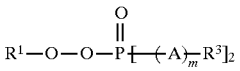

(II and wherein the substitutents such as R are as illustrated in the referred to copending application and, for example, wherein m is a number of from, for example, about 2 to about 500, or about 5 to about 100, and wherein in embodiments the weight average molecular weight, $M_w$ of A is, for example, from about 100 to about 300, or from about 104 to about 2,500, and which A is available from Aldrich Chemicals.

In the surfactant, formulas $R^1$ can be alkyl, aryl, halogen and the like, and more specifically methylphenyl, ethylphenyl, propylphenyl, butylphenyl, pentylphenyl, hexylphenyl, octylpenyl, or nonylphenyl; $R^2$ can be alkyl, aryl, halogen and the like, and more specifically hydrogen, methyl, ethyl, methylphenyl, or propyl, $R^3$ is alkyl, aryl, halogen and the like, and more specifically hydrogen, methyl, ethyl, propyl, or butyl; A can be polyoxyalkylene glycol, polyethylene glycol, or polypropylene glycol, or wherein $R^1$ is preferably an alkylphenyl such as octylphenyl, $R^2$ is a methyl, $R^3$ is methyl and A is polyethylene glycol. More specifically, the cleavable nonionic surfactants selected can be of the Formulas (I), (II), or (III), or mixtures thereof, and preferably of Formulas (I) or (II)

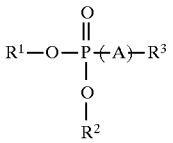

(I)

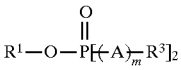

(II)

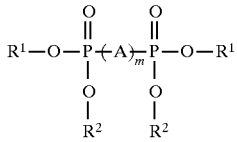

(III)

wherein $R^1$ is a hydrophobic moiety selected from, for example, the group consisting of alkyl, aryl, and their substituted derivatives such as those containing a halogen atom such as fluorine, chlorine or bromine, and wherein the alkyl group contains, for example, from about 4 to about 60, and preferably from about 6 to about 30 carbon atoms, and aryl contains, for example, from about 6 to about 60, and preferably from about 10 to about 30 carbon atoms; $R^2$ may be the same as $R^1$ or different, and can be selected from the group consisting of alkyl, aryl, and their substituted derivatives; $R^3$ is preferably hydrogen or alkyl of from, for example, about 1 to about 10, and preferably 1 to about 3 carbon atoms; A is a hydrophilic polymer chain selected, for example, from the group consisting of polyoxyalkylene, poly(vinyl alcohols), poly(saccharides) and the like, and preferably is a polyoxyalkylene derived from the same or different alkylene oxides with from about 2 to about 4 carbon atoms; and m is the number of repeating units of the hydrophilic polymer chain, and can be a number of, for example, from about 2 to about 500, and preferably from about 5 to about 100. Specific examples of surfactants are poly(ethylene glycol) methyl p-tert-octylphenyl phosphate, poly(ethylene glycol)-α-methyl ether-ω-methyl p-tert-octylphenyl phosphate, poly(ethylene glycol) methyl decylphenyl phosphate, poly(ethylene glycol)-α-methyl ether-ω-methyl dodecylphenyl phosphate, poly (ethyleneglycol) methyl dodecylphenyl phosphate, bis[poly (ethylene glycol)-α-methyl ether]-ω-p-tert-octylphenyl phosphate, poly(ethylene glycol)-α,ω-methyl p-tert-octylphenyl phosphate, poly(ethylene glycol) ethyl p-tert-octylphenyl phosphate, poly(ethylene glycol)-α-methyl ether-ω-ethyl p-tert-octylphenyl phosphate, poly(ethylene glycol) phenyl p-tert-octylphenyl phosphate, poly(ethylene glycol)-α-methyl ether-ω-phenyl p-tert-octylphenyl phosphate, poly(ethylene glycol) tolyl p-tert-octylphenyl phosphate, poly(ethylene glycol)-α-methyl ether-ω-tolyl p-tert-octylphenyl phosphate, and poly(ethylene oxide-co-propylene oxide) methyl p-tert-octylphenyl phosphate, and preferably wherein the polymer chain contains from about 5 to about 50 repeating units or segments.

Also, more specifically the present invention relates to the preparation of toner particles in the size range of about 2 to about 25 microns and preferably about 4 to about 11 microns by the aggregation of resin particles preferably in the size range of 0.05 to 0.5 microns and more preferably about 0.08 to 0.4 microns in size suspended in an aqueous media containing an anionic surfactant in the range amount of about 0.1 to about 5 and preferably about 0.15 to about 4 weight percent by weight of water and a hydrolyzable nonionic surfactant, in the range amount of about 0.1 to 5 and preferably about 0.15 to about 4 weight percent by weight of water with submicron pigment particles in the size range of about 0.05 to about 0.5 microns and preferably about 0.08 to about 0.4 microns in size containing a cationic surfactant in an amount of about 0.1 to about 5 and preferably about 0.15 to about 4 weight percent by weight of water; followed by stirring and heating the above mixture to a temperature of about 5 to 10 degrees below the resin glass transition temperature (Tg) to obtain loosely bound aggregates of resin and pigment particles wherein the aggregates are in the size range of about 3 to about 25 microns and preferably about 4 to about 9 microns in size; followed by the addition of a surfactant stabilizer in an amount about 0.2 to about 10 weight percent and preferably about 0.25 to 5 by weight of water, to prevent any further growth of the aggregates during coalescence; followed by a pH increase from acidic where the pH is in the range of 1.7 to 2.5 to a pH range which is slightly acidic to a basic condition, that is for example, a pH of about 6 to about 12 and preferably from about 7 to about 11.5, as measured with a pH meter by adding a aqueous base solution of an alkole metal hydroxide, such as potassium hydroxide. The amounts of base selected to achieve the pH change is dependent for example on the concentration of the base solution which is in the range of for example about 2 to about 10 percent based on the weight by weight of water and preferably about 3 to about 9 weight percent, with the remainder being water. Moreover the pH adjustment or an increase is preferably performed at elevated temperatures, for example about 75 degrees Centigrade to 120 degrees Centigrade and preferably about 80 to about 115 degrees Centigrade during coalescence.

The present invention relates, for example, to processes for the preparation of toner compositions by the aggregation/ coalescence of latex and colorant, especially pigment particles, and wherein the temperature of aggregation can be selected to control the aggregate size, and thus the final toner particle size, and the coalescence temperature and time can be utilized to control the toner shape and surface properties, and wherein there is selected a cleavable nonionic surfactant as illustrated herein and which processes comprise mixing a submicron in size colorant dispersion and a submicron in size, about 0.05 about 0.5 in volume average diameter of resin contained in a latex emulsion, and wherein the latex emulsion contains a surfactant, and wherein the surfactant is preferably of the Formulas (I) or (II), or optionally mixtures thereof

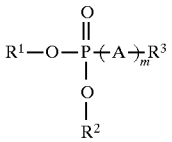

(I)

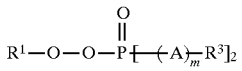

(II wherein $R^1$ is a hydrophobic aliphatic or hydrophobic group and m represents the number of A segments and $R^2$, $R^3$, and A are as illustrated herein; heating below about or equal to about the resin latex glass transition temperature to form aggregates followed by heating above about or equal to about the resin Tg to coalesce the aggregates; adding a base to achieve a pH of from about 6 to about 12 and which base is added during the second half of the coalescence step, where the second half is the time of for example from about 8 to about 12 hours wherein the total coalescence time is from about 16 to about 24 hours, and preferably about 2.5 to about 3.5 hours when the total time of the coalescence is about 4 hours; cooling; isolating the toner by washing the toner particles once with water to remove the byproducts of the hydrolysis, and drying the toner, and which toner possesses a high tribo charge of about −30 to about −45 uc/gm-as determined by the known Faraday Cage method; a process wherein the aggregation temperature is from about 45 degrees Centigrade to about 55 degrees Centigrade, and wherein the coalescence or fusion temperature is from about 85 degrees Centigrade to about 95 degrees Centigrade; a process wherein the colorant is a pigment and wherein the pigment dispersion contains an ionic surfactant, and the latex emulsion contains said surfactant and which surfactant is a cleavable nonionic surfactant of Formulas I or II, and an ionic surfactant of opposite charge polarity to that of ionic surfactant present in said colorant dispersion; a process wherein the surfactant utilized in preparing the colorant dispersion is a cationic surfactant, and the ionic surfactant present in the latex mixture is an anionic surfactant; a process wherein the aggregation is accomplished at a temperature of about 15 degrees Centigrade to about 5 degrees Centigrade below the Tg of the latex resin for a duration of from about 0.5 hours to about 3 hours followed by the addition of the surfactant stabilizer; and wherein the coalescence or fusion of the components of aggregates for the formation of integral toner particles comprised of colorant, and resin is accomplished at a temperature of from about 85 degrees Centigrade to about 95 degrees Centigrade for a duration of from about 1 hour to about 5 hours, wherein the pH of the reactor contents comprised of resin and colorant particles suspended in an aqueous media of mixed surfactants such as anionic, cationic and nonionic surfactants is changed from an acidic conditions where the pH is in the range of 1.7 to 2.5 to a pH range which is slightly acidic to a basic condition, that is for example, a pH of 6 to 12 and preferably from about 7 to about 11.5 as measured with a pH meter by the addition of a base; a process wherein the latex resin, or polymer is selected from the group consisting of poly(styrene-alkyl acrylate), poly(styrene-1,3-diene), poly (styrene-alkyl methacrylate), poly(styrene-alkyl acrylate-acrylic acid), poly(styrene-1,3-diene-acrylic acid), poly (styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), and poly(alkyl acrylate-acrylonitrile-acrylic acid), wherein said resin is present in an effective amount of from about 80 percent by weight to about 98 percent by weight of toner, and wherein said colorant is a pigment; a process wherein the latex resin is selected from the group consisting of poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), and poly(butyl acrylate-isoprene); poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), and poly(styrene-butyl acrylate-acrylononitrile-acrylic acid), and wherein said colorant is a dye or pigment; a process wherein the anionic surfactant is selected from the group consisting of sodium dodecyl sulfate, sodium dodecylbenzene sulfate and sodium dodecylnaphthalene sulfate; a process wherein the colorant is carbon black, cyan, yellow, magenta, or mixtures thereof; a process wherein the toner particles isolated are from about 2 to about 10 microns in volume average diameter, and the particle size distribution thereof is from about 1.15 to about 1.30, a process wherein the ionic surfactant utilized represents from about 0.01 to about 5 weight percent of the total reaction mixture; a process wherein there is added to the surface of the formed toner metal salts, metal salts of fatty acids, silicas, metal oxides, or mixtures thereof, each in an amount of from about 0.1 to about 10 weight percent of the obtained toner particles; freezing or maintaining the size of aggregates with an anionic surfactant or a combination of anionic and nonionic hydrolyzable surfactant; and coalescing or fusing said aggregates by heating and adjusting the pH of the reactor contents to a pH of about 6 to about 12 during coalescence. The toner generated need not be washed, however minimal washings for example one wash with deionised water is preferred to remove byproducts resulting from the hydrolysis of the nonionic surfactant into a hydrophobic alkylphenol such as octylphenol and a hydrophilic polyethylene glycol under basic conditions and other impurities such as hydroquanone and inhibitors present in the monomers arising from the emulsion synthesis and the aggregation, coalescence process.

The present invention is, furthermore specifically, directed to a process comprised of blending an aqueous colorant, especially pigment dispersion containing an ionic surfactant with a latex emulsion comprised of polymer particles, preferably submicron in size, of from, for example, about 0.05 micron to about 0.3 micron in volume average diameter, a cleavable nonionic surfactant as illustrated herein by the Formulas (I), (II), or mixtures thereof, such as a polyethyloxylate phenol, and an ionic surfactant of opposite charge polarity to that of the ionic surfactant in the colorant dispersion, thereafter heating the resulting flocculent mixture at, for example, from about 35 degrees Centigrade to about 60 degrees Centigrade (Centigrade) and preferably from about 40 to 52 degrees Centigrade to form toner sized aggregates of from about 2 microns to about 20 microns and preferably from 2 to 12 microns in volume average diameter, and which toner is comprised of polymer, colorant, such as pigment and optionally additive particles, followed by heating the aggregate suspension at, for example, from about 70 degrees Centigrade to about 120 degrees Centigrade to effect coalescence and fusion of the components of the aggregates; subsequently adding a base, such as potassium hydroxide, to adjust the pH of the toner mixture where the toner mixture is comprised of resin, colorant and optional additives and which pH is basic, for example from about 8 to about 12, and which pH is preferably adjusted during the second half of the coalescence, where the second half refers to the time for example from about 2.5 to about 3.5 hours when the total coalescence time is about 4 hours, cooling, then isolating and drying the toner; processes for the preparation of toner compositions which comprises blending an aqueous colorant dispersion preferably containing a pigment, such as carbon black, phthalocyanine, quinacridone or RHODAMINE B™ type, red, green, orange, brown, and the like, with a cationic surfactant, such as benzalkonium chloride, and with a latex emulsion and wherein the latex resin, or polymer is derived from the emulsion polymerization of monomers selected, for example, from the group consisting of styrene, butadiene, acrylates, methacrylates, acrylonitrile, acrylic acid, methacrylic acid, and the like, and which latex contains an anionic surfactant such as sodium dodecylbenzene sulfonate and a hydrolyzable nonionic surfactant of the formulas illustrated herein and which latex resin is of a size of, for example, from about 0.05 to about 0.5 microns in volume average diameter and which colorant is of a size of from about 0.05 to about 0.5 microns; heating the resulting flocculent mixture at a temperature ranging from about 35 degrees Centigrade to about 60 degrees Centigrade for an effective length of time of, for example, 0.5 hours to about 2 hours to form toner sized aggregates; subsequently heating the aggregate suspension at a temperature at or below about 95 degrees Centigrade to provide toner particles; adding a base and isolating the toner product by, for example, filtration; processes comprising:

(i) the preparation, or provision of a latex emulsion comprising resin particles, such as styrene, butylacrylate, acrylic acid, cleavable or hydrolyzable nonionic surfactant (hydrolyzing the cleavable surfactant involves the addition of water across a chemical bond in the form of, for example, water or hydroxide ions, and wherein heating can be selected to increase the speed of the hydrolysis in presence of a basic conditions), an ionic surfactant, a water soluble initiator and a chain transfer agent, (ii) blending an aqueous colorant like a pigment dispersion containing an ionic surfactant with the latex emulsion;

(iii) heating the resulting mixture at a temperature about 25 degrees Centigrade to about 1 degrees Centigrade below the Tg (glass transition temperature) of the latex polymer to form toner sized aggregates;

(iv) subsequently stabilizing the aggregates with anionic surfactant and heating the stabilized aggregate suspension to a temperature of about 80 degrees Centigrade to about 97 degrees Centigrade to effect coalescence or fusion of the components of aggregates to enable formation of integral toner particles comprised of polymer and colorant, especially pigment, and adding base to obtain a pH of from about 6 to about 12, and cooling; and processes comprising (i) preparing an ionic colorant mixture by dispersing a colorant, such as carbon black, HOSTAPERM PINK™, or PV FAST BLUE™, in an aqueous surfactant solution containing a cationic surfactant, such as dialkylbenzene dialkylammonium chloride like SANIZOL B-50™ available from Kao or MIRAPOL™ available from Alkaril Chemicals, by means of a high shearing device such as a Brinkmann Polytron or IKA homogenizer or an ultimizer;

(ii) adding the aforementioned colorant, mixture to a latex emulsion of polymer particles of, for example, poly(styrene-butyl acrylate-acrylic acid), poly(styrene-butadiene-acrylic acid), and the like, an anionic surfactant, such as sodium dodecylsulfate, dodecylbenzene sulfonate or NEOGEN R™, and the cleavable or hydrolyzable nonionic surfactant of the formulas illustrated herein, or mixtures thereof, thereby causing a flocculation of colorant, polymer particles;

(iii) homogenizing the resulting flocculent mixture with a high shearing device, such as a Brinkmann Polytron or IKA homogenizer, and further stirring with a mechanical stirrer at a temperature of about 5 degrees Centigrade to about 25 degrees Centigrade below the Tg of the latex polymer to form toner sized aggregates;

(iv) and heating the mixture in the presence of additional anionic surfactant at a temperature of 95 degrees Centigrade or below for a duration of, for example, from about 1 to about 5 hours to form toner particles with a particle size distribution of from about 1.15 to about 1.25 as measured by the Coulter Counter; adding a base during this heating to initiate the hydrolysis of the nonionic cleavable surfactant; and (v) isolating the toner particles by filtration, and drying.

The particle size of the toner compositions provided by the processes of the present invention in embodiments can be controlled by the temperature at which the aggregation of latex, colorant, such as pigment, and optional additives is conducted. In general, the lower the aggregation temperature, the smaller the aggregate size, and thus the final toner size. For a latex polymer with a glass transition temperature (Tg) of about 55 degrees Centigrade and a reaction mixture with a solids content of about 12 percent by weight, an aggregate size of about 6 microns in volume average diameter is obtained at an aggregation temperature of about 50 degrees Centigrade; the same latex will provide an aggregate size of about 5 microns at a temperature of about 45 degrees Centigrade under similar conditions.

The aggregate size stabilizer can be added prior to, or during the coalescence to prevent the aggregates from growing in size with increasing temperature, and which stabilizer is generally an anionic surfactant or optionally a mixture of anionic and a nonionic hydrolyzable surfactant as illustrated herein.

Illustrative examples of specific latex resin, polymer or polymers selected for the process of the present invention include known polymers such as poly(styrene-butadiene), poly(methyl methacrylate-butadiene), poly(ethyl methacrylate-butadiene), poly(propyl methacrylate-butadiene), poly(butyl methacrylate-butadiene), poly (methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly (propyl acrylate-isoprene), poly(butyl acrylate-isoprene), poly(styrene-butylacrylate), poly(styrene-butadiene), poly (styrene-isoprene), poly(styrene-butyl methacrylate), poly (styrene-butyl acrylate-acrylic acid), poly(styrene-butadiene-acrylic acid), poly(styrene-isoprene-acrylic acid), poly(styrene-butyl methacrylate-acrylic acid), poly(butyl methacrylate-butyl acrylate), poly(butyl methacrylate-acrylic acid), poly(styrene-butyl acrylate-acrylonitrile-acrylic acid), poly(acrylonitrile-butyl acrylate-acrylic acid), and the like. The latex polymer, or resin is generally present in the toner compositions of the present invention in various suitable amounts, such as from about 75 weight percent to about 98, or from about 80 to about 95 weight percent of the toner, and the latex size suitable for the processes of the present invention can be, for example, from about 0.05 micron to about 1 micron in volume average diameter as measured by the Brookhaven nanosize particle analyzer. Other sizes and effective amounts of latex polymer may be selected in embodiments. The total of all toner components, such as resin and colorant, is about 100 percent, or about 100 parts.

The polymer selected for the process of the present invention is preferably prepared by emulsion polymerization methods, and the monomers utilized in such processes include, for example, styrene, acrylates, methacrylates, butadiene, isoprene, acrylic acid, methacrylic acid, acrylonitrile, and the like. Known chain transfer agents, for example dodecanethiol, from, for example, about 0.1 to about 10 percent, or carbon tetrabromide in effective amounts, such as for example from about 0.1 to about 10 percent, can also be utilized to control the molecular weight properties of the polymer when emulsion polymerization is selected. Also, the reactant initiators, chain transfer agents, and the like as disclosed in U.S. Ser. No. 922,437, the disclosure of which is totally incorporated herein by reference, can be selected for the processes of the present invention.

Various known colorants, such as pigments, selected for the processes of the present invention and present in the toner in an effective amount of, for example, from about 1 to about 20 percent by weight of toner, and preferably in an amount of from about 3 to about 10 percent by weight, that can be selected include, for example, carbon black like REGAL 330®; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600 ™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Specific examples of pigments include phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E. D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E. I. DuPont de Nemours & Company, and the like. Generally, colored pigments that can be selected are cyan, magenta, or yellow pigments, and mixtures thereof. Examples of magentas that may be selected include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans that may be selected include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellows that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as pigments with the process of the present invention.

Colorants, include pigment, dye, mixtures of pigment and dyes, mixtures of pigments, mixtures of dyes, and the like.

Examples of initiators selected for the processes of the present invention include water soluble initiators such as ammonium and potassium persulfates in suitable amounts, such as from about 0.1 to about 8 percent and preferably in the range of from about 0.2 to about 5 percent (weight percent). Examples of organic soluble initiators include Vazo peroxides, such as Vazo 64, 2-methyl 2-2'-azobis propanenitrile, Vazo 88, 2-2'-azobis isobutyramide dehydrate in a suitable amount, such as in the amount of from about 0.1 to about 8 percent, and examples of chain transfer agents include dodecane thiol, octane thiol, carbon tetrabromide and the like selected in various suitable amounts, such as about 0.1 to about 10 percent and preferably about 0.2 to about 5 percent by weight of monomer.

Surfactants in effective amounts of, for example, from about 0.01 to about 15, or from about 0.01 to about 5 weight percent of the reaction mixture in embodiments include, for example, anionic surfactants, such as for example, sodium dodecylsulfate (SDS), sodium dodecylbenzene sulfonate, sodium dodecylnaphthalene sulfate, dialkyl benzenealkyl, sulfates and sulfonates, abitic acid, available from Aldrich, NEOGEN R™, NEOGEN SC™ obtained from Kao, cationic surfactants, such as for example dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™ available from Alkaril Chemical Company, SANIZOL™ (benzalkonium chloride), available from Kao Chemicals, and the like, in effective amounts of, for example, from about 0.01 percent to about 10 percent by weight. Preferably, the molar ratio of the cationic surfactant used for flocculation to the anionic surfactant used in the latex preparation is in the range of from about 0.5 to about 4 (from about to about includes all the valves in between throughout).

Examples of surfactants, which can be added to the aggregates prior to coalescence is initiated can be selected from anionic surfactants, such as for example sodium dodecylbenzene sulfonate, sodium dodecylnaphthalene sulfate, dialkyl benzenealkyl, sulfates and sulfonates, abitic acid, available from Aldrich, NEOGEN R™, NEOGEN SC™ obtained from Kao, and the like; nonionic surfactants such as polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™, and hydrolyzable or cleavable nonionic surfactants of the formulas illustrated herein, such as poly(ethylene glycol) methyl p-tert-octylphenyl phosphate, wherein the surfactant contains, for example, 40 ethylene glycol units, poly (ethylene glycol)-α-methyl ether-ω-methyl p-tert-octylphenyl phosphate (wherein the surfactant contains 17 ethylene glycol units). An effective amount of the anionic or nonionic surfactant utilized in the coalescence to stabilize the aggregate size against further growth with temperature is, for example, from about 0.01 to about 10 percent by weight, and preferably from about 0.5 to about 5 percent by weight of reaction mixture.

The toner may also include known charge additives in effective suitable amounts of, for example, from 0.1 to 5 weight percent such as alkyl pyridinium halides, bisulfates, the charge control additives of U.S. Pat. Nos. 3,944,493; 4,007,293; 4,079,014; 4,394,430 and 4,560,635, which illustrates a toner with a distearyl dimethyl ammonium methyl sulfate charge additive, the disclosures of which are totally incorporated herein by reference, negative charge enhancing additives like aluminum complexes, other known charge additives, and the like.

Surface additives that can be added to the toner compositions preferably after washing or drying include, for example, metal salts, metal salts of fatty acids, colloidal silicas, metal oxides, strontium titanates, mixtures thereof, and the like, which additives are each usually present in an amount of from about 0.1 to about 2 weight percent, reference for example U.S. Pat. Nos. 3,590,000; 3,720,617; 3,655,374 and 3,983,045, the disclosures of which are totally incorporated herein by reference. Preferred additives include zinc stearate and AEROSIL R972™ available from Degussa in amounts of from about 0.1 to about 2 percent, which additives can be added during the aggregation or blended into the formed toner product.

Developer compositions can be prepared by mixing the toners obtained with the processes of the present invention with known carrier particles, including coated carriers, such as steel, ferrites, and the like, reference U.S. Pat. Nos. 4,937,166 and 4,935,326, the disclosures of which are totally incorporated herein by reference, for example from about 2 percent toner concentration to about 8 percent toner concentration. The carrier particles can also be comprised of a core with a polymer coating thereover, such as polymethylmethacrylate (PMMA) having dispersed therein a conductive component like conductive carbon black. Carrier coatings include silicone resins, fluoropolymers, mixtures of resins not in close proximity in the triboelectric series, thermosetting resins, and other known components.

Imaging methods are also envisioned with the toners of the present invention, reference for example a number of the patents mentioned herein, and U.S. Pat. Nos. 4,265,660; 4,858,884; 4,584,253 and 4,563,408, the disclosures of which are totally incorporated herein by reference.

The following Examples are being submitted to further illustrate various aspects of the present invention. These Examples are intended to be illustrative only and are not intended to limit the scope of the present invention. Comparative Examples and data are also provided. The surfactants of Formulas (I) or (II) were prepared as illustrated in copending applications U.S. Ser. No. 960,754 and 960,176.

EXAMPLE 1

LATEX PREPARATION

A latex emulsion comprised of polymer particles generated from the emulsion polymerization of styrene, butyl acrylate and acrylic acid was prepared as follows. A mixture of 2,255 grams of styrene, 495 grams of butyl acrylate, 55.0 grams of acrylic acid, 27.5 grams of carbon tetrabromide and 96.25 grams of dodecanethiol was added to an aqueous solution prepared from 27.5 grams of ammonium persulfate in 1,000 milliliters of water and 2,500 milliliters of an aqueous solution containing 62 grams of anionic surfactant, NEOGEN® and 33 grams of poly(ethylene glycol)-α-methyl ether-ω-methyl p-tert-octylphenyl phosphate hydrolyzable cleavable nonionic surfactant. The resulting mixture was emulsified at room temperature, about 25 degrees Centigrade, under a nitrogen atmosphere for 30 minutes. Subsequently, the mixture was stirred and heated to 70 degrees Centigrade (Centigrade throughout) at a rate of 1 degrees Centigrade per minute, and retained at this temperature for 6 hours. The resulting latex polymer of poly(styrene-co butyl acrylate-co-acrylic acid) possessed an $M_w$ of 29,300, an $M_n$ of 7,212, measured by Gel Permeation Chromatography, and a mid-point Tg of 55.6 degrees Centigrade measured using Differential Scanning Calorimetry.

COMPARATIVE LATEX EXAMPLE 2

A latex emulsion comprised of polymer particles generated from the emulsion polymerization of styrene, butyl acrylate and acrylic acid was prepared as follows. A mixture of 2,255 grams of styrene, 495 grams of butyl acrylate, 55.0 grams of acrylic acid, 27.5 grams of carbon tetrabromide and 96.25 grams of dodecanethiol was added to an aqueous solution prepared from 27.5 grams of ammonium persulfate in 1,000 milliliters of water and 2,500 milliliters of an aqueous solution containing 62 grams of anionic surfactant, NEOGEN R™ and 33 grams of ANTAROX™ CA897. The resulting mixture was emulsified at room temperature of about 25 degrees Centigrade under a nitrogen atmosphere for 30 minutes. Subsequently, the mixture was stirred and heated to 70 degrees Centigrade (Centigrade throughout) at a rate of 1 degrees Centigrade per minute, and retained at this temperature for 6 hours. The resulting latex polymer possessed an $M_w$ of 30,500, an $M_n$ of 6,900, measured by Gel Permeation Chromatography, and a mid-point Tg of 54.9 degrees Centigrade measured by differential scanning Calorimetry.

Aggregation of Yellow Toner 60 gm of latex 1 (Example 1) prepared above and containing submicron styrene-butylacrylate acrylic acid copolymer resin particles of 0.17 microns volume average diameter, suspended in an aqueous phase of anionic surfactant with the base cleavable/hydrolyzable nonionic was simultaneously added with 32 gm of a pigment dispersion available from Sun Chemicals containing 9.23 gm of pigment Yellow 17 and 2.4 gm of cationic surfactant, Sanizol B, to 400 grams of water while being polytroned at high speeds resulting in a homogeneous blend of resin and pigment particles.

The blend was then transferred into a reaction vessel, equipped with a stirrer and the temperature of the contents was then raised to 5 degrees Centigrade below the resin Tg (resin Tg=56 degrees Centigrade), where the aggregation was performed. The particle size was monitored during this period. After 120 minutes at 51 degrees Centigrade the particle size was 6.0 microns with a GSD of 1.20. 60 mls of 20% (w/w) of the aqueous anionic surfactant was then added prior to raising the reactor temperature to 95 degrees Centigrade.

After about 3 hours into the coalescence, the reactor contents pH was increased from 2.2 to 8.5 by the addition of an aqueous alkali hydroxide, and more specifically potassium hydroxide solution having a concentration of 3.4% (w/w). The pH adjusted reactor contents were then allowed to coalesce for an additional period of 2 hours, resulting in particles comprised 92 weight percent of resin and 8 weight percent of pigment with a potato like morphology, and with a smooth surface as observed under an optical microscope.

The reactor contents were then cooled down to room temperature, followed by the filtration of the mother liquor. 20 grams of the filter cake was then removed and freeze dried (no washing). The dry toner charge as determined by the Faraday Cage method throughout was measured and found to be 42 uc/g at 20% RH measured on a carrier with a core of a ferrite, about 90 microns in diameter, with a coating of polymethylmethacrylate and carbon black, about 20 weight percent dispersed therein. The filter cake was then reslurried in deionized water and mixed for 1 hour, filtered and a portion of the filtered cake was freeze dried, (wash 1). The dry toner now resulting had a tribo charge of −45 ug/g. The process of re slurrying and re filtering and drying was repeated 2 more times wherein the wash 2 toner particles resulted in charge of −45 uc/g and the wash 3 resulted in −46 uc/g.

The (no washing) charging data indicates that there was no significant difference between 0, 1, 2 or 3 washed samples indicating that the surfactant was hydrolysed or cleaved during the coalescence process resulting in toner particles with a clean surface.

Aggregation of Cyan Toner 260 gm of Latex 1 containing submicron styrene-butylacrylate acrylic acid copolymer resin particles suspended in an aqueous phase of anionic surfactant with a base cleavable/hydrolyzable nonionic surfactant was simultaneously added with 7.6 gm of a pigment dispersion containing 4.12 gm (grams) of pigment Blue 15 obtained from Sun Chemicals and 2.4 gm of cationic surfactant, Sanizol B, to 400 grams of water while being polytroned at high speeds resulting in a homogeneous blend of resin and pigment particles.

The blend was then transferred into a reaction vessel, equipped with a stirrer and the temperature of the contents was then raised to 5 degrees Centigrade below the resin Tg (resin Tg=56 degrees Centigrade), where the aggregation was performed. The particle size was monitored during this period. After 120 minutes at 51 degrees Centigrade the particle was 6.2 microns with a GSD of 1.20. 45 mls of 20% (w/w) of the aqueous anionic surfactant NEOGEN® was then added prior to raising the reactor temperature to 95 degrees Centigrade.

After about 3 hours into the coalescence, the reactor contents pH was adjusted to 8.5 with the addition of an aqueous potassium hydroxide solution having a concentration of 3.4% (w/w). The pH adjusted reactor contents comprised of resin and pigment particles suspended in an aqueous phase containing anionic, cation and hydrolyzable nonionic surfactants was then allowed to coalesce for an additional period of 2 hours, resulting in particles comprised of 96.25 weight percent of resin and 3.75 weight percent of pigment with a potato like morphology, with a smooth surface, as observed under an optical microscope.

The reactor contents comprised of toner size particles of resin and pigment suspended in an aqueous phase was then cooled down to room temperature, followed by the filtration of the mother liquor. A 20 gm of the filtercake was then removed and freeze dried ("0" wash). The dry toner charge was measured and found to be 48 uc/g at 20% RH. The remaining filter cake was then reslurried in deionised water and mixed for 1 hour, filtered and the filtercake labeled as wash 1. 20 grams of the filtered cake was freeze dried, (wash 1). The dry toner now resulted in a tribo charge of −47 ug/g. The process of re slurrying and re filtering and drying was repeated 2 more times where the wash 2 toner particles resulted in charge of −45 uc/g and wash 3 resulted in −46 uc/g.

The charging data indicates that there was no significant difference between 0, 1, 2 and 3 washed samples indicating that the surfactant was hydrolysed or cleaved during the coalescence process resulting in toner particles with a clean surface.

Aggregation of Magenta Toner 260 gm Latex 1 (Example 1 Latex throughout) containing submicron styrene-butylacrylate acrylic acid copolymer resin particles suspended in an aqueous phase of anionic surfactant with a base cleavable/hydrolyzable nonionic surfactant was simultaneously added with 10.6 gm of a pigment dispersion, containing 4. gm (grams) of pigment Red 122, 6.5 gm of a second red dispersion containing 2.68 gm of pigment Red 238, both obtained from Sun Chemicals and 2.4 gm of cationic surfactant, Sanizol B, to 400 grams of water while being polytroned at high speeds resulting in a homogeneous blend of resin and pigment particles.

The blend was then transferred into a reaction vessel, equipped with a stirrer and the temperature of the contents were then rawased to 5 degrees Centigrade below the resin Tg (resin Tg=56 degrees Centigrade), where the aggregation was performed. The particle size was monitored during this period. After 130 minutes at 51 degrees Centigrade the particle was 6.1 microns with a GSD of 1.19. 50 mls of 20% (w/w) of aqueous anionic surfactant was then added prior to raising the reactor temperature to 95 degrees Centigrade.

After about 3 hours into the coalescence step, the reactor contents pH was adjusted to 8.5 with the addition of aqueous potassium hydroxide solution having a concentration of 3.4% (w/w). The pH adjusted reactor contents were then allowed to coalesce for an additional period of 2 hours, resulting in particles comprised of 95 weight percent of resin and 5 weight percent of pigment with a potato like morphology, with a smooth surface, as observed under an optical microscope.

The reactor contents comprised of toner size particles of resin and pigment suspended in water were then cooled down to room temperature, and filtered. 20 gm of the filter cake was then removed and freeze dried ("0 wash"). The dry toner charge was measured and found to be 35 uc/g at 20%

RH. The filter cake was then reslurried in deionized water and mixed for 1 hour and re filtered (wash 1) and 20 gm of the filtered cake was freeze dried, (wash 1). The dry toner now resulted in a tribo charge of −34 ug/g. The process of re slurrying and re filtering and drying was repeated 2 more times where the was #2 toner particles resulted in charge of −36 uc/g and was 3 resulted in −34 uc/g.

The charging data indicates that there was no significant difference between 0, 1, 2 or 3 washed samples indicating that the surfactant was indeed hydrolysed or cleaved during the coalescence process resulting in toner particles with a clean surface.

Aggregation of Black Toner 260 gm of latex 1 containing submicron styrene-butylacrylate acrylic acid copolymer resin particles suspended in an aqueous phase of anionic surfactant with a base cleavable/hydrolyzable nonionic surfactant was simultaneously added with 32 gm of a pigment dispersion, obtained from Sun Chemicals containing 6.72 of pigment Black -R 330, and 2.4 gm of cationic surfactant, Sanizol B, to 400 grams of water while being polytroned at high speeds resulting in a homogeneous blend of resin and pigment particles.

The blend was then transferred into a reaction vessel, equipped with a stirrer and the temperature of the contents were then raised to 5 degrees Centigrade below the resin Tg (resin Tg=56 degrees Centigrade), where the aggregation was performed. The particle size was monitored during this period. After 120 minutes at 51 degrees Centigrade the particle was 6.3 microns with a GSD of 1.21. 50 mls of 20% (w/w) of aqueous anionic surfactant was then added prior to raising the reactor temperature to 95 degrees Centigrade.

After about 3 hours (hours) into the coalescence step, the reactor content pH was increased 2.2 to 8.5 the addition of an aqueous potassium hydroxide solution having a sodium hydroxide concentration of 3.4% (w/w). The pH adjusted reactor contents were then allowed to coalesce for an additional period of 2 hours, resulting in particles comprised of 94 weight percent of resin and 6 weight percent of pigment with a potato like morphology, with a smooth surface as observed under an optical microscope.

The reactor contents comprised of toner size particles of resin and pigment suspended in an aqueous water phase were then cooled down to room temperature, followed by the filtration of the mother liquor. 20 gms of the filter cake was then removed and freeze dried ("0 wash"). The dry toner charge was measured and found to −28 uc/g at 20% RH. The filter cake was the reslurried in DIW and mixed for 1 hour and re filtered (wash 1) and the portion of the filtered cake was freeze dried, (wash 1). The dry toner now resulted in a tribo charge of −26 ug/g. The process of re slurrying and re filtering and drying was repeated 2 more times where the wash 2 toner particles resulted in charge of −27 uc/g and wash 3 resulted in −28 uc/g.

The washing data indicates that there was no significant difference between 0, 1, 2, or 3 and 4 washed samples indicating that the surfactant was indeed hydrolysed or cleaved during the coalescence process resulting in toner particles with a clean surface.

Aggregation of Cyan Toner: (pH adjusted early)

260 gm of Latex 1 containing submicron styrene-butylacrylate acrylic acid copolymer resin particles suspended in an aqueous phase of anionic surfactant with a base cleavable/hydrolyzable nonionic surfactant was simultaneously added with 7.6 gm of a pigment dispersion available from Sun Chemicals containing 4.12 gm of pigment Blue 15.3 and 2.4 gm of cationic surfactant, Sanizol B, to 400 grams of water while being polytroned at high speeds resulting in a homogeneous blend of resin and pigment particles.

The blend was then transferred into a reaction vessel, equipped with a stirrer and the temperature of the contents was then raised to 5 degrees Centigrade below the resin Tg (resin Tg=56 degrees Centigrade), where the aggregation was accomplished. The particle size was monitored during this period. After 115 minutes at 51 degrees Centigrade the particle was 6.0 microns with a GSD of 1.19. 45 mls of 20% (w/w) of aqueous anionic surfactant was added prior to raising the reactor temperature to 95 degrees Centigrade.

After about 1 hour into the coalescence step, the reactor content pH was adjusted to 8.5 with the addition of aqueous potassium hydroxide solution having a concentration of 3.4% (w/w). The pH adjusted reactor contents were then allowed to coalesce for an additional period of 3 hours, resulting in a breakdown of the 6 micron aggregates into smaller pigmented particles of 0.5 to 2 micron range.

COMPARATIVE EXAMPLES

Aggregation of Yellow Toner 260 gm of latex 2 (Example 2) containing submicron styrene-butylacrylate acrylic acid copolymer resin particles suspended in an aqueous phase of anionic surfactant with nonionic surfactant Anthrox CA 987 was simultaneously added with 32 gm of a pigment dispersion containing 9.23 gm of pigment Yellow 17 and 2.4 grams of cationic surfactant, Sanizol B, to 400 grams of water while being polytroned at high speeds resulting in a homogeneous blend of resin and pigment particles.

The blend was then transferred into a reaction vessel, equipped with a stirrer and the temperature of the contents was then raised to 5 degrees Centigrade below the resin Tg (resin Tg=55 degrees Centigrade), where the aggregation was performed. The particle size was monitored during this period. After 130 minutes at 50 degrees Centigrade the particle was 6.2 microns with a GSD of 1.21. 60 mls of 20% (w/w) of aqueous anionic surfactant was then added prior to raising the reactor temperature to 95 degrees Centigrade.

The reactor contents comprised of toner size particles of resin and pigment suspended in an aqueous water phase was then cooled down to room temperature, and filtered. A portion, 20 gm of the filter cake was then removed and freeze dried ("0 wash").

The dry toner charge as determined by the Faraday Cage method throughout was measured and found to be −9 uc/g at 20% RH measured on a carrier with a core of a ferrite, about 90 microns in diameter, with a coating of polymethylmethacrylate and carbon black, about 20 weight percent dispersed therein. The filter cake was the reslurried in DIW and mixed for 1 hour and re filtered (wash #1) and the portion of the filtered cake was freeze dried, (wash #1). The dry toner now resulted in a tribo charge of −9 uc/g. The process of re slurrying and re filtering and drying was repeated 4 more times where the wash #2 toner particles resulted in charge of −11 uc/g and wash #3 resulted in −16 uc/g, wash #5 resulted tribo charge of −18 uc/g and wash #6 being −18 uc/g.

The washing data indicates that extensive water washing important in achieving tribo improvements.

Aggregation of Cyan Toner 260 gm of latex 2 containing submicron styrene-butylacrylate acrylic acid copolymer resin particles suspended in an aqueous phase of anionic surfactant with nonionic surfactant Anthrox CA 987 was simultaneously added with 7.6 gm of a pigment dispersion containing 4.12 gm of pigment blue 15.3 and 2.4 gm of cationic surfactant, Sanizol B, to 400 grams of water while being polytroned at high speeds resulting in a homogeneous blend of resin and pigment particles.

The blend was then transferred into a reaction vessel, equipped with a stirrer and the temperature of the contents was then raised to 5 degrees Centigrade below the resin Tg (resin Tg=55 degrees Centigrade), where the aggregation was performed. The particle size was monitored during this period. After 130 minutes at 50 degrees Centigrade the particle was 6.0 microns with a GSD of 1.20. 40 mls of 20% (w/w) of aqueous anionic surfactant was then added prior to raising the reactor temperature to 95 degrees Centigrade.

The reactor contents comprised of toner size particles of resin and pigment suspended in a water phase was then cooled down to room temperature, and filtered. A portion (20 grams throughout) of the filter cake was then removed and freeze dried ("0 wash").

The dry toner charge as determined by the Faraday Cage method throughout was measured and found to be −12 uc/g at 20% RH measured on a carrier with a core of a ferrite, about 90 microns in diameter, with a coating of polymethylmethacrylate and carbon black, about 20 weight percent dispersed therein. After 5 more further washing with deionized water the toner was dried and exhibited a tribo value of −26 uc/g indicating that washing the surfactant off, from the toner particle surface was essential to achieving a toner tribo improvement.

Aggregation of Magenta Toner 260 gm of latex 2 containing submicron styrene-butylacrylate acrylic acid copolymer resin particles suspended in an aqueous phase of anionic surfactant with nonionic surfactant Anthrox CA 987 was simultaneously added with 10.6 of a pigment dispersion containing 4 gm of pigment Red 122, 6.5 gm of another dispersion containing 2.68 gm of Red 238 pigment and 2.4 gm of cationic surfactant, Sanizol B, to 400 grams of water while being polytroned at high speeds resulting in a homogeneous blend of resin and pigment particles.

The blend was then transferred into a reaction vessel, equipped with a stirrer and the temperature of the contents was then raised to 5 degrees Centigrade below the resin Tg (resin Tg=55 degrees Centigrade), where the aggregation was performed. The particle size was monitored during this period. After 115 minutes at 50 degrees Centigrade the particle was 6.4 microns with a GSD of 1.19. 50 mls of 20% (w/w) of aqueous anionic surfactant was then added prior to raising the reactor temperature to 95 degrees Centigrade.

The reactor contents comprised of toner size particles of resin and pigment suspended in an aqueous water phase was then cooled down to room temperature, followed by the filtration of the mother liquor. 20 gm of the filter cake was then removed and freeze dried ("0 wash").

The dry toner charge as determined by the Faraday Cage method throughout was measured and found to be 6 uc/g at 20% RH measured on a carrier with a core of a ferrite, about 90 microns in diameter, with a coating of polymethylmethacrylate and carbon black, about 20 weight percent dispersed therein. After 5 more further washing with deionized water the toner was dried and exhibited a tribo value of 21 uc/g indicating that washing the surfactant off, from the toner particle surface was essential to achieve tribo improvements. The pH adjustment was not as effective when non hydrolyzable surfactants were used such as Anthrox Ca 897 as compared to a toner prepared using a hydrolyzable cleavable nonionic surfactant.

Aggregation of Black Toner 260 gm of latex 2 containing submicron styrene-butylacrylate acrylic acid copolymer resin particles suspended in an aqueous phase of anionic surfactant with nonionic surfactant Anthrox CA 987 was simultaneously added with 32 gm of a pigment dispersion comprised of pigment particles in water throughout, available from Sun Chemicals containing 6.72 gm of Black Regal 330 pigment and 2.4 gm of cationic surfactant, Sanizol B, to 400 grams of water while being polytroned at high speeds resulting in a homogeneous blend of resin and pigment particles.

The resulting blend was then transferred into a reaction vessel, equipped with a stirrer and the temperature of the contents was then raised to 5 degrees Centigrade below the resin Tg (resin Tg=55 degrees Centigrade), where the aggregation was performed. The particle size was monitored during this period. After 125 minutes at 50 degrees Centigrade the toner particle was 6.2 microns with a GSD of 1.22. 50

The reactor contents comprising of toner size particles of resin and pigment suspended in an aqueous phase were then allowed to cool to room temperature, and filtered. 20 gm of the filter cake was then removed and freeze dried ("0 wash").

The dry toner charge as determined by the Faraday Cage method throughout was measured and found to be −4 uc/g at 20% RH measured on a carrier with a core of a ferrite, about 90 microns in diameter, with a coating of polymethylmethacrylate and carbon black, about 20 weight percent dispersed therein. After 5 more further washing with deionized water the toner was dried and exhibited a tribo value of −15 uc/g indicating that removing the surfactant by washing, from the toner particle surface enabled the achievement of a toner bribe charge improvement.

PREPARATION OF SURFACTANTS

EXAMPLE I

Synthesis of Poly(ethylene glycol) Methyl 4-tert-octylphenyl phosphate (XI) wherein m is about 40:

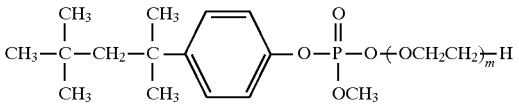

(XI)

Preparation of 4-tert-octylphenyl dichlorophosphate:

In a 500 milliliter round bottomed flask equipped with a magnetic stirrer and fitted with a reflux condenser, which was connected to a magnesium sulfate dry tube, were placed 25.0 grams (0.121 mole) of 4-tert-octylphenol, 57 grams (0.372 mole) of phosphorus oxychloride, and 0.35 gram (0.0036 mole) of magnesium chloride. The reaction mixture resulting was then heated to a reflux temperature of 110 degrees Centigrade and maintained at this temperature for 6 hours. The unreacted phosphorus oxychloride was distilled off and the reaction mixture was cooled to room temperature, about 25 degrees Centigrade, to provide an oily mixture which contains 39.8 grams of 4-tert-octylphenyl dichlorophosphate.

In a 3 liter round bottomed flask equipped with a mechanical stirrer and fitted with an 100 milliliter addition funnel were added the 4-tert-octylphenyl dichlorophosphate as prepared above and 250 milliliters of anhydrous toluene, while in the addition funnel were placed 3.9 grams (0.121 mol) of methanol and 9.6 grams (0.121 mol) of pyridine. The flask was cooled with an ice bath and the mixture of methanol and pyridine was added through the addition funnel over a period of 0.5 hour. After the addition, the reaction mixture was stirred for an additional 1.0 hour. Into this mixture were added a solution of 182 grams of poly(ethylene glycol) obtained from Aldrich Chemicals and with an average molecular weight $M_w$ of 1,500, in 500 milliliters of anhydrous toluene and then followed by the addition of 9.6 grams of pyridine. After stirring for 0.5 hour, the ice bath was removed, and the reaction mixture was stirred for 12 hours. The precipitated pyridine hydrochloride solids were filtered off and the liquid mixture was concentrated by distilling the volatile materials to yield 195 grams of a waxy solid. The surfactant composition product (XI) was characterized by proton NMR. The chemical shifts in $CDCl_3$ are: 0.7 (s), 1.36 (s), 1.72 (s), 3.66 (m, PEG backbone), 3.84 (d), 4.27 (m), 7.12 (d), 7.31 (d).

EXAMPLE II

Synthesis of Poly(ethylene glycol) α-Methyl Ether ω-Methyl 4-tert-octylphenyl Phosphate (XII) Wherein m is about 17:

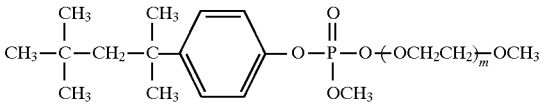

(XII)

In a one liter round bottomed flask equipped with a magnetic stirrer and fitted with a reflux condenser, which condenser was connected to a magnesium sulfate dry tube, were placed 250 milliliters of anhydrous toluene and 100 grams of poly(ethyleneglycol) monomethyl ether with an average molecular weight of 750. The flask was cooled with an ice bath, and to the stirred mixture there were added 45 grams (0.139 mol) of 4-tert-octylphenyl dichlorophosphate and 11 grams (0.139 mol) of pyridine. After 0.5 hour, the ice bath was removed and the reaction mixture was stirred at room temperature for 5.0 hours. The reaction was completed by adding 20 milliliters of methanol and 11.0 grams of pyridine, and the stirring was maintained for another 3.0 hours. The precipitated pyridine hydrochloride solids were removed by filtration, and the filtrate was concentrated under reduced pressure to yield 125 grams of a liquid. The surfactant composition product (XII) was characterized by proton NMR. The chemical shifts in $CDCl_3$ are: 0.7 (s), 1.36 (s), 1.71 (s), 3.38 (s), 3.66 (m, PEG backbone), 3.85 (d), 4.27 (m), 7.12 (d), 7.34 (d).

EXAMPLE III

Synthesis of Bis[poly(ethylene glycol)] α-Methyl Ether ω-Methyl 4-tert-octylphenyl phosphate (XIII) Wherein m is about 17:

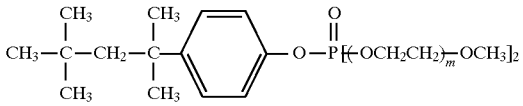

(XIII)

In a one liter round bottomed flask equipped with a magnetic stirrer and fitted with a reflux condenser, which was connected to a magnesium sulfate dry tube, were placed 150 milliliters of anhydrous toluene and 110 grams of poly(ethyleneglycol)monomethyl ether with an average molecular weight of 750. The flask was cooled with an ice bath, and to the stirred mixture there were added 22.6 grams (0.07 mol) of 4-tert-octylphenyl dichlorophosphate and 11.0 grams (0.139 mol) of pyridine. After 0.5 hour, the ice bath was removed and the reaction mixture was stirred at room temperature for 5.0 hours. The precipitated pyridine hydrochloride solids were removed by filtration, and the liquid filtrate was concentrated under reduced pressure to yield 118 grams of a waxy solid. The surfactant composition product (XIII) was characterized by proton NMR. The chemical shifts in $CDCl_3$ are: 0.7 (s), 1.36 (s), 1.70 (s), 3.39 (s), 3.66 (m, PEG backbone), 4.27 (m), 7.10 (d), 7.35 (d).

EXAMPLE IV

Synthesis of Bis[poly(ethylene glycol)] α-Methyl Ether ω-Methyl 4-Tert-octylphenyl phosphate (XIII) Wherein M is about 40:

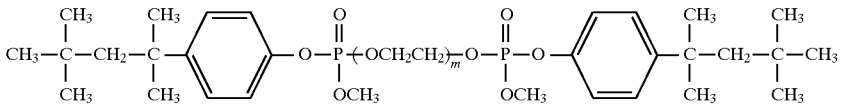

(XIV)

In a 3 liter round bottomed flask equipped with a mechanical stirrer and fitted with an 100 milliliters addition funnel, were added the 4-tert-octylphenyl dichlorophosphate as prepared above and 250 milliliters of anhydrous toluene, while in the addition funnel were placed 3.9 grams (0.121 mol) of methanol and 9.6 grams (0.121 mol) of pyridine. The flask was cooled with an ice bath and the mixture of methanol and pyridine was added through the addition funnel over a period of 0.5 hour. After the addition, the reaction mixture was stirred for an additional 1.0 hour. Into this mixture was added a solution of 90 grams of poly(ethylene glycol) with an average molecular weight of 1,500 in 500 milliliters of anhydrous toluene and there followed by 20 grams of pyridine. After stirring for 0.5 hour, the ice bath was removed, and the reaction mixture was stirred for 12.0 hours. The precipitated pyridine hydrochloride solids were filtered off and the liquid mixture remaining was concentrated by distilling the volatile materials to yield 115 grams of a liquid. The surfactant composition product (XIV) was characterized by proton NMR. The chemical shifts in $CDCl_3$ are: 0.71 (s), 1.37 (s), 1.72 (s), 3.67 (m, PEG backbone), 3.85 (d), 4.27 (m), 7.12 (d), 7.32 (d).

EXAMPLES V AND VI

Examples II and III were repeated substituting, respectively, a poly(ethylene glycol) monomethyl ether with an average molecular weight of 2,000 for the poly(ethylene glycol) monomethyl ether of Examples II and III. There were obtained nonionic surfactants (XV) and (XVI) whose structures are represented by Formulas (XII) and (XIII), wherein m is about 45, respectively. The chemical shifts of surfactant (XV) in $CDCl_3$ are: 0.7 (s), 1.35 (s), 1.71 (s), 3.37 (s), 3.67 (m, PEG backbone), 3.84 (d), 4.27 (m), 7.12 (d), 7.33 (d). The chemical shifts of surfactant (XVI) in $CDCl_3$ are: 0.69 (s), 1.36 (s), 1.70 (s), 3.40 (s), 3.66 (m, PEG backbone), 4.26 (m), 7.10 (d), 7.34 (d).

EXAMPLE VII

Example II was repeated substituting dodecylphenol for the 4-tert-octylphenol of Example II, resulting in the surfactant (XVII) wherein m is about 17

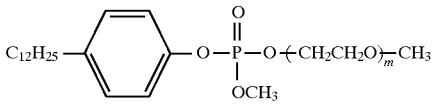

(XVII)

The chemical shifts of surfactant (XVII) in $CDCl_3$ are: 0.85 (t), 1.30 (m), 2.51(t), 3.38 (s), 3.66 (m, PEG backbone), 3.85 (d), 4.27 (m), 7.10 (d), 7.34 (d).

Other modifications of the present invention may occur to those skilled in the art subsequent to a review of the present application and these modifications, including equivalents thereof, are intended to be included within the scope of the present invention.

What is claimed is:

1. A process for the preparation of toner comprising mixing a colorant containing a surfactant and a latex emulsion, and wherein the latex emulsion contains resin and a nonionic hydrolyzable surfactant, and wherein said surfactant is of the Formulas (I) or (II), or optionally mixtures thereof

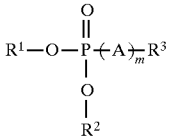

(I)

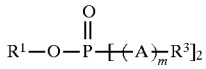

(II)

wherein $R^1$ is a hydrophobic aliphatic, or hydrophobic aromatic group; $R^2$ is selected from the group consisting of hydrogen, alkyl, aryl, alkylaryl, and alkylarylalkyl; $R^3$ is hydrogen or alkyl; A is a hydrophilic polymer chain, and m represents the number of A segments; heating below about or about equal to the resin latex glass transition temperature, followed by the addition of an anionic stabilizer, thereafter heating above about or about equal to the resin glass transition temperature, and adjusting the pH of the resulting mixture of resin and colorant particles suspended in an aqueous phase containing anionic surfactant, cationic surfactant and nonionic hydrolyzable surfactant, wherein said pH is increased or about equal to about 6 to about 12 by adding a base during the heating above about said resin glass transition temperature wherein coalescence is being accomplished.

2. A process in accordance with claim 1 wherein heating below about the resin latex glass transition temperature forms loosely bound particles that are electrostatically held together and wherein heating above about the resin glass transition temperature coalesces the aggregates; and subsequent to adjusting said pH the toner formed is isolated and dried.

3. A process in accordance with claim 1 herein the base is added during the second half of the coalescence about 2.5 to about 4.5 hours.

4. A process in accordance with claim 1 wherein said base is added about 8 to about 14 hours after the coalescence, or heating about above the latex resin glass transition temperature is initiated.

5. A process in accordance with claim 1 wherein the base is an alkali metal hydroxide.

6. A process in accordance with claim 1 wherein the base is sodium hydroxide, potassium hydroxide, or ammonium hydroxide.

7. A process in accordance with claim 1 wherein after the addition of base there results a pH of the reactor mixture of about 6 to about 12 increased from about 1.7 to about 2.5.

8. A process in accordance with claim 7 wherein there results a pH of about 7 to about 11.5.

9. A process in accordance with claim 1 wherein m is a number of from about 5 to about 60, or from about 10 to about 50, and wherein the weight average molecular weight of A is from about 100 to about 3,000.

10. A process in accordance with claim 1 wherein $R^1$ is methylphenyl, ethylphenyl, propylphenyl, butylphenyl, pentylphenyl, hexylphenyl, octylpenyl, or nonylphenyl; $R^2$ is hydrogen, methyl, ethyl, methylphenyl, or propyl; $R^3$ is methyl, ethyl, propyl, or butyl; and A is polyoxyalkylene glycol, polyethylene glycol, or polypropylene glycol.

11. A process in accordance with claim 1 wherein $R^1$ is an alkylaryl group, or an alkylaryl group with a substituent of fluorine, chlorine, or bromine, wherein alkyl contains from about 2 to about 30 carbon atoms; $R^2$ alkyl contains from 1 to about 30 carbon atoms; $R^3$ alkyl contains from 1 to about 3 carbon atoms; and wherein A is a hydrophilic poly (oxyalkylene glycol) selected from the group consisting of a branched, block or homopolymeric polyoxyalkylene glycol derived from alkylene oxides with from about 2 to about 4 carbon atoms.

12. A process in accordance with claim 1 wherein the latex resin is generated from the polymerization of monomers to provide a latex emulsion with submicron resin particles in the size range of from about 0.05 to about 0.3 micron in volume average diameter and wherein the latex contains an anionic surfactant, a water soluble initiator and a chain transfer agent.

13. A process in accordance with claim 1 wherein the colorant dispersion comprises submicron pigment particles in the size range of from about 0.05 to 0.3 microns in volume average diameter stabilized by a nonionic surfactant.

14. A process in accordance with claim 1 wherein said cleavable surfactant is selected in an amount of from about 0.05 to about 10 weight percent based on the amount of monomer selected to generate said resin latex.

15. A process in accordance with claim 2 wherein the aggregation temperature is from about 45 degrees Centigrade to about 55 degrees Centigrade, and wherein the coalescence or fusion temperature is from about 85 degrees Centigrade to about 95 degrees Centigrade.

16. A process in accordance with claim 1 wherein said colorant is a pigment, or a dye.

17. A process in accordance with claim 1 wherein the surfactant utilized in the colorant dispersion is a cationic surfactant, and an anionic surfactant is present in the latex mixture, wherein the heating below is accomplished at a temperature of about 15 degrees Centigrade to about 5 degrees Centigrade below the Tg of the latex resin for a duration of from about 0.5 hour to about 3 hours; and wherein the heating above or coalescence of the components of aggregates for the formation of integral toner particles comprised of colorant, and resin is accomplished at a temperature of from about 85 degrees Centigrade to about 95 degrees Centigrade for a duration of from about 1 hour to about 5 hour, wherein the pH of the mixture of resin and colorant particles suspended in an aqueous phase is increased from about 2.2 to about 8.5 by the addition of said base.

18. A process in accordance with claim 1 wherein the latex resin, or polymer is selected from the group consisting of poly(styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly(styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), and poly(alkyl acrylate-acrylonitrile-acrylic acid).

19. A process in accordance with claim 1 wherein the latex resin is selected from the group consisting of poly (styrene-butadiene), poly(methylstyrene-butadiene), poly (methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), and poly(butyl acrylate-isoprene); poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), and poly(styrene-butyl acrylate-acrylononitrile-acrylic acid).

20. A process in accordance with claim 17 wherein the anionic surfactant is selected from the group consisting of sodium dodecyl sulfate, sodium dodecylbenzene sulfate and sodium dodecylnaphthalene sulfate.

21. A process in accordance with claim 1 wherein the colorant is carbon black, cyan, yellow, magenta, or mixtures thereof.

22. A process in accordance with claim 1 wherein the toner particles isolated are from about 2 to about 10 microns in volume average diameter, and the particle size distribution thereof is from about 1.15 to about 1.26 of the total reaction mixture.

23. A process in accordance with claim 1 wherein there is added to the surface of the formed toner metal salts, metal salts of fatty acids, silicas, metal oxides, or mixtures thereof, each in an amount of from about 0.1 to about 10 weight percent of the obtained toner particles.

24. A process in accordance with claim 1 wherein the hydrolyzable surfactant is selected from the group consisting of poly(ethylene glycol) methyl p-tert-octylphenyl phosphate, poly(ethylene glycol)-α-methyl ether-ω-methyl p-tert-octylphenyl phosphate, poly(ethylene glycol) methyl decylphenyl phosphate, poly(ethylene glycol)-α-methyl ether-ω-methyl dodecylphenyl phosphate, poly (ethyleneglycol) methyl dodecylphenyl phosphate, bis[poly (ethylene glycol)-α-methyl ether]-ω-p-tert-octylphenyl phosphate, poly(ethylene glycol)-α,ω-methyl p-tert-octylphenyl phosphate, poly( ethylene glycol) ethyl p- tert-octylphenyl phosphate, poly(ethylene glycol)-α-methyl ether-ω-ethyl p-tert-octylphenyl phosphate, poly(ethylene glycol) phenyl p-tert-octylphenyl phosphate, poly(ethylene glycol)-α-methyl ether-ω-phenyl p-tert-octylphenyl phosphate, poly(ethylene glycol) tolyl p-tert-octylphenyl phosphate, poly(ethylene glycol)-α-methyl ether-ω-tolyl p-tert-octylphenyl phosphate, and poly(ethylene oxide-co-propylene oxide) methyl p-tert-octylphenyl phosphate, wherein the polymer chain contains from about 5 to about 50 repeating units or segments.

25. A process in accordance with claim 1 wherein said surfactant in the colorant containing a surfactant is an ionic surfactant.

26. A process in accordance with claim 1 wherein said surfactant in the colorant containing a surfactant is a cationic surfactant.

27. A process in accordance with claim 1 wherein said surfactant in the colorant containing a surfactant is comprised of a mixture of anionic, cationic, and nonionic surfactants.

28. A process for the preparation of toner comprising mixing a colorant containing a cationic surfactant and a latex emulsion, and wherein the latex emulsion contains resin and a nonionic hydrolyzable surfactant, and wherein said surfactant is of the Formulas (I) or (II), or optionally mixtures thereof

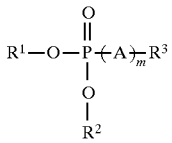

(I)

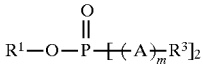

(II)

wherein $R^1$ is a hydrophobic aliphatic, or hydrophobic aromatic group; $R^2$ is selected from the group consisting of hydrogen, alkyl, aryl, alkylaryl, and alkylarylalkyl; $R^3$ is hydrogen or alkyl; A is a hydrophilic polymer chain, and m represents the number of A segments; heating below about or about equal to the resin latex glass transition temperature, followed by the addition of an anionic stabilizer, thereafter heating above about or about equal to the resin glass transition temperature, and adjusting the pH of the resulting mixture of resin and colorant particles suspended in an aqueous phase containing anionic surfactant, cationic surfactant and nonionic hydrolyzable surfactant, wherein said pH is increased or about equal to about 6 to about 12 by adding a base during the heating above about said resin glass transition temperature wherein coalescence is being accomplished.

* * * * *